US006729086B2

(12) United States Patent
Razetto

(10) Patent No.: US 6,729,086 B2
(45) Date of Patent: May 4, 2004

(54) ANGULAR SECTION MEMBER FOR MAKING WALL CORNERS

(76) Inventor: Geom Vladimiro Razetto, Via Monte Berico, 7 20030 Lentate sul Seveso, (Milano) (IT)

( * ) Notice: Subject to any disclaimer, the term of this patent is extended or adjusted under 35 U.S.C. 154(b) by 0 days.

(21) Appl. No.: 10/038,629

(22) Filed: Jan. 2, 2002

(65) Prior Publication Data

US 2002/0083665 A1 Jul. 4, 2002

(30) Foreign Application Priority Data

Jan. 3, 2001 (IT) ..... MI20010002 U

(51) Int. Cl.[7] ..... E04B 2/00

(52) U.S. Cl. ..... 52/287.1; 52/254; 52/726.1; 403/292

(58) Field of Search ..... 52/254, 255, 256, 52/257, 287.1, 288.1, 726.1; 403/292, 298

(56) References Cited

U.S. PATENT DOCUMENTS

| | | | | | |
|---|---|---|---|---|---|
| 560,605 | A | * | 5/1896 | Union | 52/255 |
| 741,288 | A | * | 10/1903 | Union | 52/255 |
| 780,344 | A | * | 1/1905 | Hurlbert | 52/256 |
| 1,035,278 | A | * | 8/1912 | von Rehder | 52/256 |
| 1,106,730 | A | * | 8/1914 | Sanderson | 52/256 |
| 1,111,153 | A | * | 9/1914 | Heinz | 52/256 |
| 1,308,773 | A | * | 7/1919 | Clark | 52/255 |
| 1,624,121 | A | * | 4/1927 | Thiem | 52/371 |
| 2,189,216 | A | * | 2/1940 | Mathias | 52/216 |
| 2,267,002 | A | * | 12/1941 | Turner | 52/255 |
| 2,332,146 | A | * | 10/1943 | Holdsworth | 52/255 |
| 2,643,423 | A | * | 6/1953 | Brendel | 52/255 |
| 2,682,321 | A | * | 6/1954 | Brock | 403/306 |
| 3,412,512 | A | * | 11/1968 | Hollister | 52/239 |
| 3,442,542 | A | * | 5/1969 | Watanabe | 403/300 |
| 4,733,986 | A | * | 3/1988 | Kenning et al. | 403/306 |
| 5,203,135 | A | * | 4/1993 | Bastian | 52/726.1 |
| 5,531,051 | A | * | 7/1996 | Chenier et al. | 52/255 |
| 5,625,986 | A | * | 5/1997 | Mansfield et al. | 52/255 |
| 5,740,642 | A | * | 4/1998 | Koenig et al. | 52/255 |

* cited by examiner

*Primary Examiner*—Brian E. Glessner
(74) *Attorney, Agent, or Firm*—Hedman & Costigan, P.C.

(57) ABSTRACT

An angular section member for making wall corners includes a metal sheet element which is bent by pressure along a plurality of longitudinal lines to provide a profile defining three dihedral angles, i.e. an inner dihedral angle and two outer dihedral angles and a projecting rib at the corner of the inner dihedral angles.

1 Claim, 4 Drawing Sheets

ANGULAR SECTION MEMBER FOR MAKING WALL CORNERS

BACKGROUND OF THE INVENTION

The present invention relates to an angular section member which has been specifically designed for making wall corners in buildings and the like.

As is known, in the building field is frequently required to use an angular section member allowing to provide, in a very accurate and quick manner, the corners of masonry walls or separating walls and the like, in any desired types of building and by busing any desired types of construction materials and methods.

Prior approaches conventionally comprise "L"-bent section members, having a plurality of holes of a diameter of 4–5 cm through the overall surface thereof, with the exception of the bent or folded region thereof.

The latter is delimited by two surfaces which are bent through about 90°.

In operation, the user, before performing leveling operations, applies the corner protective angular section member, which, in particular, is arranged on the corner region to be finished by plaster, adhesive materials or nails, which are caused to pass through the above mentioned small holes.

Then, the leveling operations are performed, in which the nails are removed, if the latter must be used for fixing the section members.

In such a case, after having removed the nail elements, it is necessary to finish again the corner to be made.

The corner protective section member or profile is usually left in the finished work, in order to provide both a perfect finishing of the article of manufacture, and a reinforcement protection therefor.

Conventional section members can also be made starting from a drawn sheet metal material, in order to provide a better clamping thereof.

The subject section member, on the contrary, comprises a metal sheet element which is bent, by pressure, along a plurality of longitudinally extending lines, to provide a profile having three dihedral angles, having a common apex.

A dihedral angle, which is herein called the inner dihedral angle, since it forms the inner portion of the construction to be made, is delimited by the two inner faces of the section member.

The remaining two outer angles, are, on the contrary, delimited by the outer surfaces of the sides defining the inner angle, and by two outer faces of the section member, which is bent on itself along its longitudinal middle axis, thereby defining a projecting or raised rib.

The latter is arranged in the laying plane formed by the plane crossing the inner dihedral angle into two either equal or different portions.

The angular element according to the present invention is differentiated from conventional angular elements for like application, since it comprises a reinforced rib arrangement, forming the mentioned projecting apex tip, in addition to the two sides delimiting said inner angle, which comprise portions formed by further bending said section member along two lines parallel to the middle axis thereof.

The mentioned longitudinal lines are arranged transversely of said axis and are spaced at such spacings that they can be, or not, equal and symmetrical.

Moreover, a feature of the subject angular section member which distinguishes it from conventional angular section members is that, the thickness being the same, the subject section member has a great impact strength or resistance, which makes its finishing operations more easy and quick.

SUMMARY OF THE INVENTION

In particular, the aim of the present invention is to provide such an angular section member allowing to make, in an accurate and quick manner, corners of building article of manufactures having a great impact strength.

This aim is achieved owing to the fact that the angular section member of the present invention is provided with suitable perforations only through the reinforced rib forming the projecting tip, or through the overall surface thereof, thereby providing a greater embedding of said building article of manufacture, and further facilitating and accelerating the finishing operations.

Within the scope of the above mentioned aim, a main object of the present invention is to provide an angular section member which can be easily used under any constructional conditions for making said constructional work.

Another object of the present invention is to provide such an angular section member which, owing to its specifically designed features, is very reliable and safe in operation.

Yet another object of the present invention is to provide such an angular section member which is very competitive from a mere economic standpoint.

According to one aspect of the present invention, the above mentioned aim and objects, as well as yet other objects, which will become more apparent herein after, are achieved by an angular section member, specifically designed for construction or building application, having the features of the accompanying claims.

BRIEF DESCRIPTION OF THE DRAWINGS

Further characteristics and advantages of the present invention will become more apparent hereinafter from the following detailed disclosure of a preferred, though not exclusive, embodiment of the angular section member specifically designed for building application according to the present invention, which is illustrated, by way of an indicative, but not limitative example, in the figures of the accompanying drawings, where.

DESCRIPTION OF THE PREFERRED EMBODIMENTS

Figure 2:
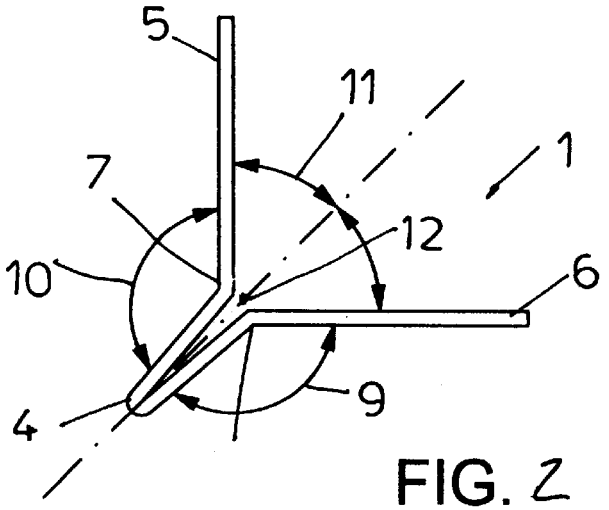
FIG. 2 is a top plan view of the angular section member according to the present invention.

With reference to the number references of the above mentioned figures, the angular section member, specifically designed for building construction, according to the present invention, and generally indicated by the reference number 1, is made starting from a metal sheet element 2, having a given thickness which, after having being cut preferably to a length of 300 cm, is bent or folded upon.

More specifically, said sheet metal element 2 is bent along its middle longitudinal axis, so as to provide two sheet metal portions overlapping one another, thereby providing a reinforced and projecting rib 3 the corner 4 of which, in addition to laying on the direction of the middle axis, provides the corner of the desired angle of the masonry article of manufacture.

The two side portions or flaps 5 and 6 are so bent as to provide a suitable angle along the longitudinal lines 8 and 7.

The latter, in particular, are preferably, through not necessarily, arranged at equal spacings and are symmetrical with respect to the middle longitudinal axis.

Thus, a section member defining three dihedral angles, i.e. an inner dihedral angle 11 and two outer dihedral angles 9 and 10, all having their vertex at a single ideal point 12, is provided.

Figure 1:
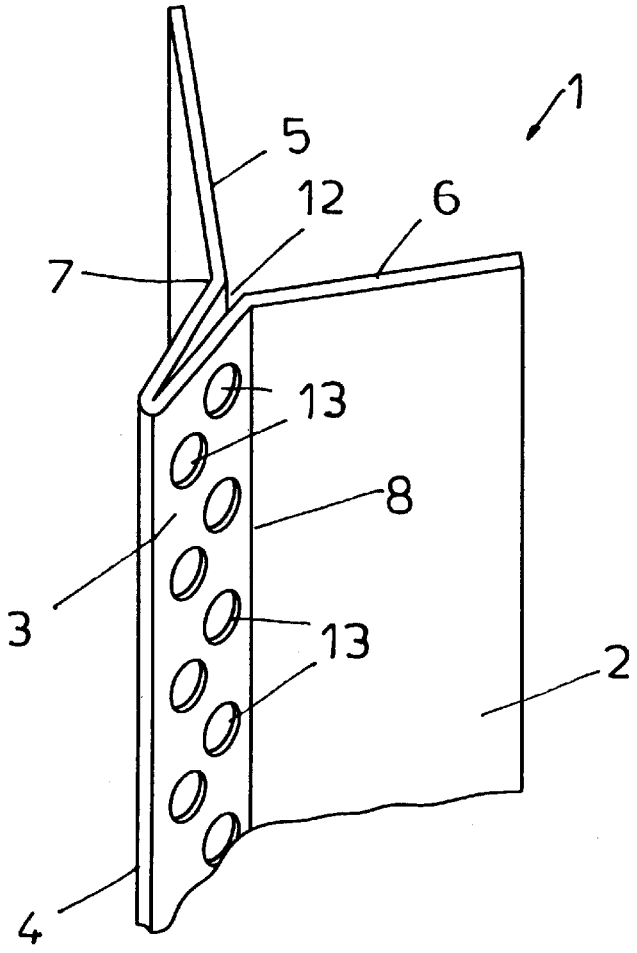
FIG. 1 is a side perspective view of the angular section member according to the present invention.
Figure 4:
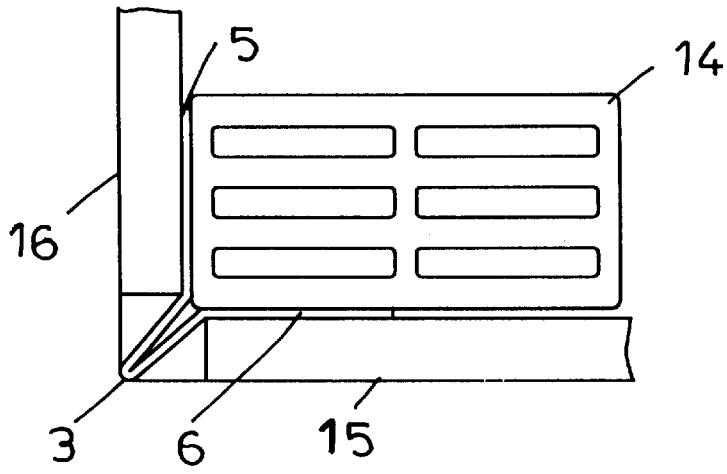
FIG. 4 is a top plan view illustrating the angular section member according to the invention.
Figure 3:
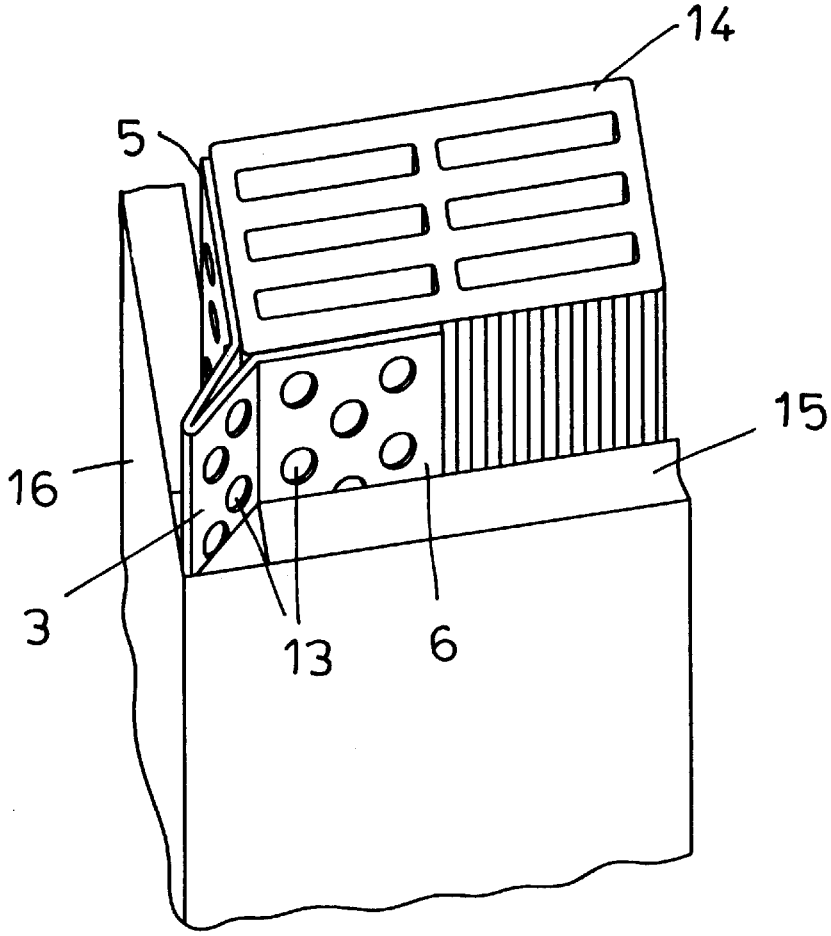
FIG. 3 is a further side perspective view of the angular section member according to the present invention, applied to a masonry construction.

More specifically, said section member is so perforated as to provide a plurality of throughgoing holes 13, having a set diameter, which can affect only the surfaces of the projecting rib 3, as shown in FIG. 1, or the overall surfaces of the sheet metal element 2, as shown in FIG. 3.

The mentioned perforations or holes allow the subject metal section member to be fully embedded in the building or constructional filling-in and finishing materials.

Thus, due to the above mentioned reason, the provision of the mentioned holes at different regions of the section member depends on the building materials and methods which are used for providing the finished masonry article of manufacture.

In the embodiment shown in FIG. 3, the subject section member must be embedded in the masonry material so as to also affect the portions 5 and 6 delimiting the inner dihedral angle 11.

The latter receives the tile or masonry element 14, whereas the projecting rib 3 is embedded in the plaster and finishing material, forming the surface layers 15 and 16 of the wall corner.

Figure 6:
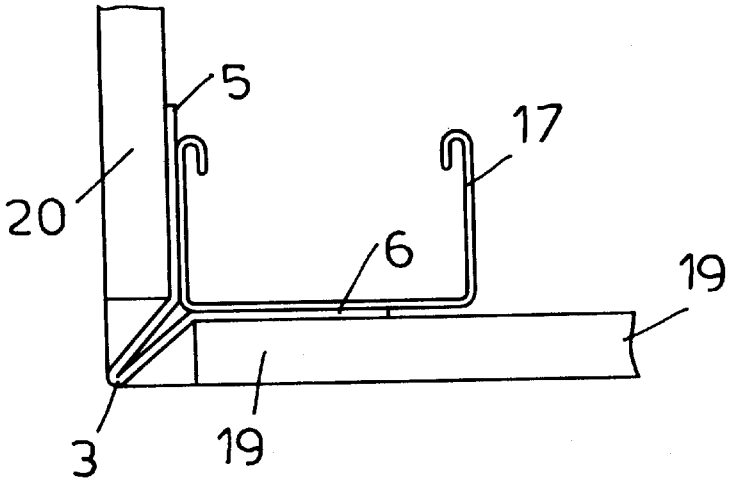
FIG. 6 is a top plan view of the above mentioned application.
Figure 5:
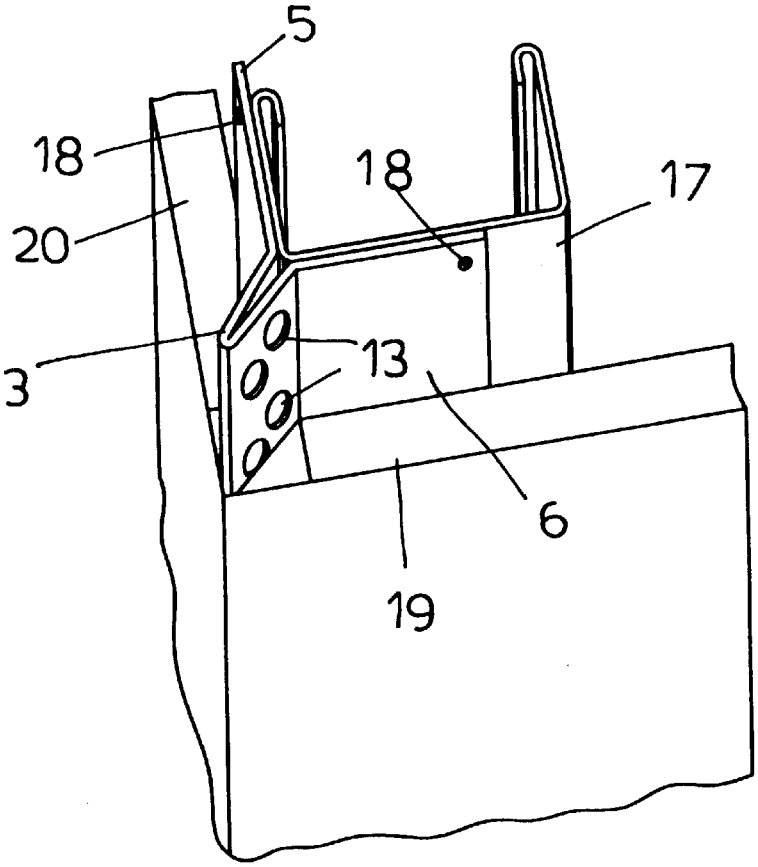
FIG. 5 illustrates a possible application of the angular section member according to the present invention to a masonry separating wall, made of paperboard-plaster material panels.

In the case of plaster-paperboard wall corners, as shown in FIGS. 5 and 6, the portions or flaps 5 and 6 of the inner dihedral angle 11 are abutted against the walls of a metal bearing column 17 of the paperboard-plaster wall construction and are clamped to said construction by iron clamping screws 18.

The panels 19 and 20 bears, in a flush relationship with the end portions of the projecting tip 3, the level of the two walls forming the corners.

In this connection it should be pointed out that finishing plaster and other materials will embed also in this case the section member therein.

Figure 7:
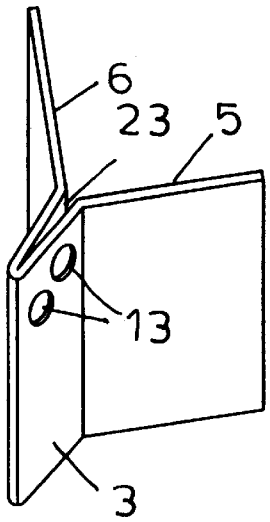
FIG. 7 is a further side perspective view illustrating a possible arrangement of an inner structural elements and the clamping thereof to provide a butt joining of two angular section members.
Figure 8:
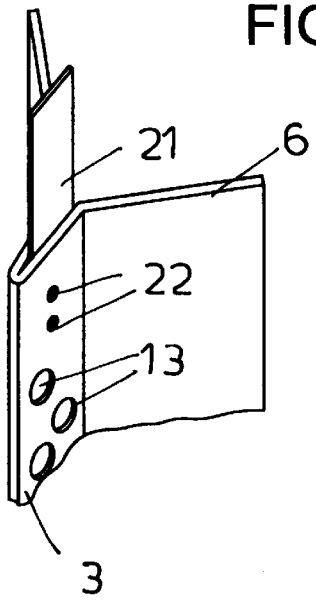
FIGS. 8 and 9 are respectively top plan views illustrating modified embodiments of the angular section member according to the invention, with different angular openings of the inner dihedral and/or of the projecting tip fold.
Figure 8:
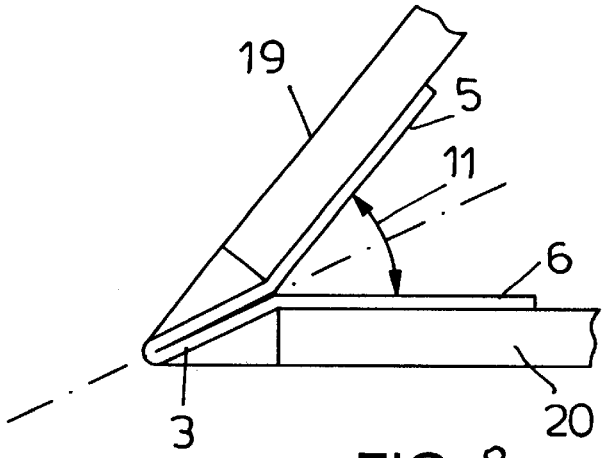
Figure 9:
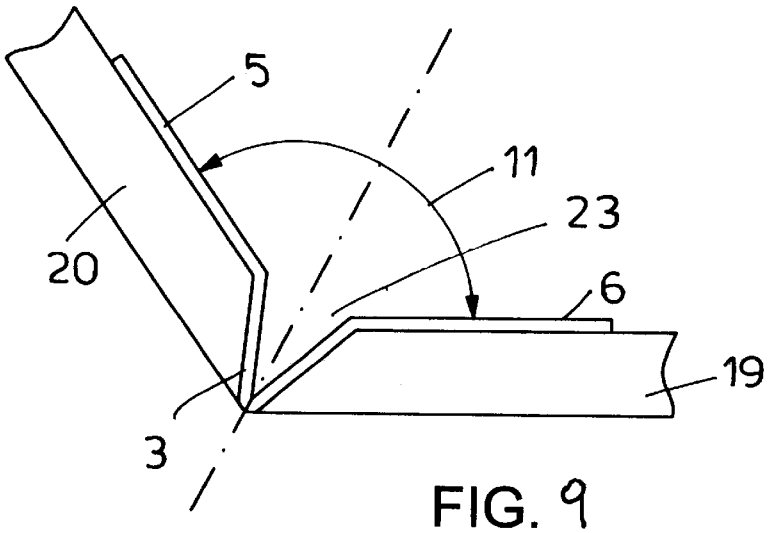

As clearly shown in FIG. 7, the section members can be butt joined by introducing a metal plate 21, having suitable size, thickness and holes, at the recesses housing the clamping screws 22.

The mentioned metal plate 21, having preferably a rectangular configuration, is arranged and clamped in the bending or fold 23 inside the projecting rib 3.

The section member according to the present invention can be made in modified embodiments providing to change the inner angle 11, to allow walls having several types of angles to be easily made.

Further modified embodiments can be also performed with respect to the angular opening of the fold 23 inside the projecting corner 3.

Thus, it is possible to provide a facilitated storing and shipment, since the subject section members can be overlapped onto one another, by providing the folded portion 23 with a suitable opening.

From the above disclosure it should be apparent that the invention fully achieves the intended aim and objects.

In particular, a very practical and functional system has been provided, allowing to easily make an angular section member for building application, which can be used for making, in a very accurate and quick manner, any desired corners, having any set angle, both in walls or dividing construction and the like.

The invention, as disclosed, is susceptible to several modifications and variations, all of which will come within the scope of the invention.

Moreover, all of the constructional details can be replaced by other technically equivalent elements.

In practicing the invention, the used materials, as well as the contingent size and shaped, can be any, depending on requirements.

What is claimed is:

1. An angular section member for making and coupling to wall corners of a building construction, said building construction comprising a masonry construction, layers of plastering, filling in and finishing material and plaster and material columns, said angular section member comprising a metal sheet element bent by pressure along a plurality of longitudinal lines to provide a profile having three dihedral angles, said three dihedral angles providing an inner dihedral angle and two outer dihedral angles, said inner dihedral angle defining a folded portion forming a projecting rib at a corner of said inner dihedral angle, a plurality of through going substantially circular holes being formed at least through said folded portion of said projecting rib, said three dihedral angles having all their vertex points at a single ideal apex point, some of said holes being provided for receiving clamping screws for claiming said angular section member to said metal columns of said building construction, and a metal plate engaged in said inner dihedral angle and clamped therein by said clamping screws for butt joining said angular section member to metal columns of said building construction.

* * * * *